US009366409B2

(12) United States Patent
Holland et al.

(10) Patent No.: US 9,366,409 B2
(45) Date of Patent: Jun. 14, 2016

(54) TUNABLE LIGHTING APPARATUS

(71) Applicant: LIGHTING SCIENCE GROUP CORPORATION, Satellite Beach, FL (US)

(72) Inventors: Eric Holland, Indian Harbour Beach, FL (US); Mark P. Boomgaarden, Satellite Beach, FL (US); Ryan Kelley, Denver, CO (US)

(73) Assignee: Lighting Science Group Corporation, Melbourne, FL (US)

( * ) Notice: Subject to any disclaimer, the term of this patent is extended or adjusted under 35 U.S.C. 154(b) by 581 days.

(21) Appl. No.: 13/739,893

(22) Filed: Jan. 11, 2013

(65) Prior Publication Data

US 2013/0293148 A1 Nov. 7, 2013

Related U.S. Application Data

(60) Provisional application No. 61/643,299, filed on May 6, 2012.

(51) Int. Cl.

| | |
|---|---|
| ***H05B 37/02*** | (2006.01) |
| ***F21V 5/04*** | (2006.01) |
| ***H05B 33/08*** | (2006.01) |
| ***F21K 99/00*** | (2016.01) |
| ***F21V 5/00*** | (2015.01) |
| *F21Y 101/02* | (2006.01) |
| *F21Y 105/00* | (2016.01) |
| *F21Y 113/00* | (2016.01) |

(52) U.S. Cl.

CPC ... *F21V 5/04* (2013.01); *F21K 9/13* (2013.01); *F21V 5/007* (2013.01); *H05B 33/0833* (2013.01); *F21Y 2101/02* (2013.01); *F21Y 2105/003* (2013.01); *F21Y 2113/005* (2013.01)

(58) Field of Classification Search

USPC ..... 315/297

See application file for complete search history.

(56) References Cited

U.S. PATENT DOCUMENTS

| | | | | |
|---|---|---|---|---|
| 5,264,997 | A * | 11/1993 | Hutchisson et al. | 362/645 |
| 5,523,878 | A | 6/1996 | Wallace et al. | |
| 5,680,230 | A | 10/1997 | Kaburagi et al. | |
| 5,704,701 | A | 1/1998 | Kavanagh et al. | |
| 5,997,150 | A | 12/1999 | Anderson | |
| 6,140,646 | A | 10/2000 | Busta et al. | |
| 6,341,876 | B1 | 1/2002 | Moss et al. | |
| 6,356,700 | B1 | 3/2002 | Strobl | |
| 6,594,090 | B2 | 7/2003 | Kruschwitz et al. | |
| 6,767,111 | B1 | 7/2004 | Lai | |
| 6,787,999 | B2 | 9/2004 | Stimac et al. | |

(Continued)

FOREIGN PATENT DOCUMENTS

| | | | |
|---|---|---|---|
| CN | 101 702 421 | A | 5/2010 |
| WO | WO 2009/121539 | A1 | 10/2009 |
| WO | WO 2012/158665 | | 11/2012 |

*Primary Examiner* — Lincoln Donovan
*Assistant Examiner* — Patrick Chen
(74) *Attorney, Agent, or Firm* — Mark Malek; Stephen Bullock; Widerman Malek, PL

(57) ABSTRACT

A luminaire provides light having a distribution pattern with high center beam candle power and a gradual gradient across a wide area. The luminaire includes a light source having first and second sets of light emitting elements selected and positioned to achieve the desired light distribution pattern. The luminaire further includes an optic configured to refract light emitted from the light source to achieve the desired light distribution pattern.

15 Claims, 7 Drawing Sheets

(56) References Cited

U.S. PATENT DOCUMENTS

| | | | |
|---|---|---|---|
| 6,799,864 | B2 | 10/2004 | Bohler et al. |
| 6,817,735 | B2 | 11/2004 | Shimizu et al. |
| 6,870,523 | B1 | 3/2005 | Ben-David et al. |
| 6,871,982 | B2 | 3/2005 | Holman et al. |
| 6,974,713 | B2 | 12/2005 | Patel et al. |
| 7,072,096 | B2 | 7/2006 | Holman et al. |
| 7,075,707 | B1 | 7/2006 | Rapaport et al. |
| 7,083,304 | B2 | 8/2006 | Rhoads |
| 7,178,941 | B2 | 2/2007 | Roberge et al. |
| 7,246,923 | B2 | 7/2007 | Conner |
| 7,255,469 | B2 | 8/2007 | Wheatley et al. |
| 7,261,453 | B2 | 8/2007 | Morejon et al. |
| 7,289,090 | B2 | 10/2007 | Morgan |
| 7,300,177 | B2 | 11/2007 | Conner |
| 7,303,291 | B2 | 12/2007 | Ikeda et al. |
| 7,325,956 | B2 | 2/2008 | Morejon et al. |
| 7,342,658 | B2 | 3/2008 | Kowarz et al. |
| 7,349,095 | B2 | 3/2008 | Kurosaki |
| 7,400,439 | B2 | 7/2008 | Holman |
| 7,429,983 | B2 | 9/2008 | Islam |
| 7,434,946 | B2 | 10/2008 | Huibers |
| 7,436,996 | B2 | 10/2008 | Ben-Chorin |
| 7,438,443 | B2 | 10/2008 | Tatsuno et al. |
| 7,476,016 | B2 | 1/2009 | Kurihara |
| 7,520,642 | B2 | 4/2009 | Holman et al. |
| 7,530,708 | B2 | 5/2009 | Park |
| 7,540,616 | B2 | 6/2009 | Conner |
| 7,556,406 | B2 | 7/2009 | Petroski et al. |
| 7,598,686 | B2 | 10/2009 | Lys et al. |
| 7,598,961 | B2 | 10/2009 | Higgins |
| 7,626,755 | B2 | 12/2009 | Furuya et al. |
| 7,677,736 | B2 | 3/2010 | Kasazumi et al. |
| 7,684,007 | B2 | 3/2010 | Hull et al. |
| 7,703,943 | B2 | 4/2010 | Li et al. |
| 7,705,810 | B2 | 4/2010 | Choi et al. |
| 7,709,811 | B2 | 5/2010 | Conner |
| 7,719,766 | B2 | 5/2010 | Grasser et al. |
| 7,728,846 | B2 | 6/2010 | Higgins et al. |
| 7,766,490 | B2 | 8/2010 | Harbers et al. |
| 7,828,453 | B2 | 11/2010 | Tran et al. |
| 7,832,878 | B2 | 11/2010 | Brukilacchio et al. |
| 7,834,867 | B2 | 11/2010 | Sprague et al. |
| 7,845,823 | B2 | 12/2010 | Mueller et al. |
| 8,016,443 | B2 | 9/2011 | Falicoff et al. |
| 8,047,660 | B2 | 11/2011 | Penn et al. |
| 8,049,763 | B2 | 11/2011 | Kwak et al. |
| 8,083,364 | B2 | 12/2011 | Allen |
| 8,096,668 | B2 | 1/2012 | Abu-Ageel |
| 8,212,836 | B2 | 7/2012 | Matsumoto et al. |
| 8,297,783 | B2 | 10/2012 | Kim |
| 8,331,099 | B2 | 12/2012 | Geissler et al. |
| 8,337,029 | B2 | 12/2012 | Li |
| 2004/0052076 | A1 | 3/2004 | Mueller et al. |
| 2006/0002108 | A1 | 1/2006 | Ouderkirk et al. |
| 2006/0002110 | A1 | 1/2006 | Dowling et al. |
| 2006/0164005 | A1 | 7/2006 | Sun |
| 2006/0285193 | A1 | 12/2006 | Kimura et al. |
| 2007/0013871 | A1 | 1/2007 | Marshall et al. |
| 2007/0159492 | A1 | 7/2007 | Lo et al. |
| 2008/0094005 | A1* | 4/2008 | Rabiner et al. ..... 315/294 |
| 2008/0143973 | A1 | 6/2008 | Wu |
| 2008/0198572 | A1 | 8/2008 | Medendorp |
| 2008/0232084 | A1 | 9/2008 | Kon |
| 2009/0059585 | A1 | 3/2009 | Chen et al. |
| 2009/0128781 | A1 | 5/2009 | Li |
| 2010/0006762 | A1 | 1/2010 | Yoshida et al. |
| 2010/0202129 | A1 | 8/2010 | Abu-Ageel |
| 2010/0231863 | A1 | 9/2010 | Hikmet et al. |
| 2010/0244700 | A1 | 9/2010 | Chong et al. |
| 2010/0245227 | A1* | 9/2010 | Chen et al. ..... 345/102 |
| 2010/0264833 | A1* | 10/2010 | Van Endert et al. ..... 315/152 |
| 2010/0315320 | A1 | 12/2010 | Yoshida |
| 2010/0320928 | A1 | 12/2010 | Kaihotsu et al. |
| 2010/0320933 | A1* | 12/2010 | Lai ..... 315/294 |
| 2010/0321641 | A1 | 12/2010 | Van Der Lubbe |
| 2011/0204780 | A1* | 8/2011 | Shum et al. ..... 315/35 |
| 2011/0210678 | A1* | 9/2011 | Grajcar ..... 315/192 |
| 2011/0310446 | A1 | 12/2011 | Komatsu |
| 2012/0286700 | A1 | 11/2012 | Maxik et al. |
| 2012/0319616 | A1* | 12/2012 | Quilici ..... F21V 5/007 315/294 |

* cited by examiner

TUNABLE LIGHTING APPARATUS

RELATED APPLICATIONS

This application is related to and claims the benefit Under 35 U.S.C. §119(e) of U.S. Provisional Patent Application Ser. No. 61/643,299 titled Tunable Lighting Apparatus filed May 6, 2012, the entire contents of which are incorporated herein.

FIELD OF THE INVENTION

The present invention relates to the field of lighting and, more specifically, to lighting devices.

BACKGROUND OF THE INVENTION

The present invention relates to systems and methods for generating light, and more particularly, to luminaires. The distribution of light intensity about a luminaire is an important factor in the aesthetic appeal of the luminaire. Traditionally, luminaires having a narrow beam angle produce light having a high center beam candle power (CBCP) are useful in tasks where light needs to be focused in a limited area, but are generally not useful for area lighting. Additionally, luminaires that have a wide beam angle emit light that has a distribution of light following a gradual gradient across the area illuminated by the beam, but has a low CBCP which is often desirable, as luminaires are often directed to accentuate certain features of the area to be illuminated. Accordingly, luminaires that have both a wide beam angle with a light distribution following a gradual gradient well as a high CBCP are desirable.

Typically, luminaires that employ light emitting diodes (LEDs) as a light source are not able to accomplish both having a light distribution that follows a gradual gradient while also having high CBCP. Accordingly, there is a long felt need for a luminaire employing LEDs having both high CBCP as well as a light distribution pattern that follows a gradual gradient.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the foregoing in mind, the invention is related to a luminaire having a light distribution pattern following a gradual gradient and also having a high center beam candle power.

These and other objects, features, and advantages according to the present invention are provided by a luminaire having a light source, a lens assembly, and a housing. The light source may include one or more light emitting elements. More specifically, the light source may include a first set of light emitting elements and a second set of light emitting elements. The light emitting elements may be light emitting diodes (LEDs). The first and second sets of light emitting elements may include LEDs of different types and colors. The first and second sets of light emitting elements may include different numbers of LEDs that may be positioned on a platform. The positioning of the LEDs may be selected to alter the light distribution of the luminaire.

The lens assembly may include a lens configured to transmit and refract light emitted from the light source. The lens may be polished to alter the refracting properties of the lens.

Moreover, the lens may include two or more sections that are subject to different polishing methods and have different polishing finishes. The lens assembly may further include one or more light source receiving members configured to permit one or more light emitting elements to be positioned therein and to facilitate the transmittal and refraction of light. The light source receiving members may be associated with one or more light emitting elements, and may be formed into any shape, including conical frustums and annular ridges.

The housing may be configured to accommodate the attachment of the lens assembly and the light source to a light socket and to prevent movement or rotation with respect to each other. The housing may also be configured to carry a power source that is electrically coupled to the light source. Furthermore, the housing may be configured to dissipate heat generated by the light source and the power source.

BRIEF DESCRIPTION OF THE DRAWINGS

FIG. 6 is a side sectional view of the lens assembly illustrated in

FIG. 5 and taken through line 6-6.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Additionally, in the following detailed description, reference may be made to the driving of light emitting diodes, or LEDs. A person of skill in the art will appreciate that the use of LEDs within this disclosure is not intended to be limited to the any specific form of LED, and should be read to apply to light emitting semiconductors in general. Accordingly, skilled artisans should not view the following disclosure as limited to the any particular light emitting semiconductor device, and should read the following disclosure broadly with respect to the same.

Figure 1:
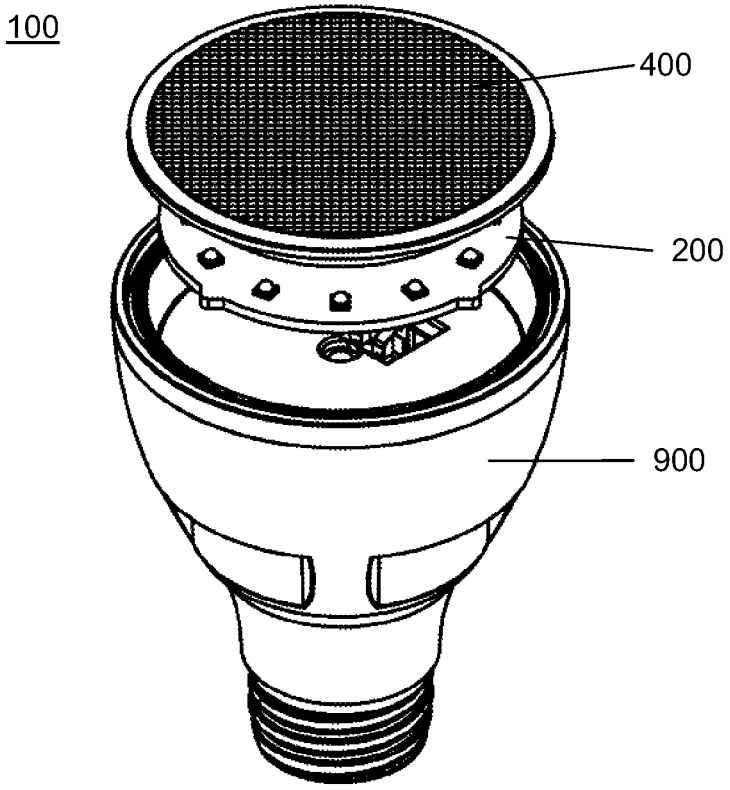
FIG. 1 is a perspective exploded view of a luminaire according to an embodiment of the invention.

In a present embodiment of the invention, as depicted in FIG. 1, a lighting apparatus 100 is provided. The lighting apparatus may include a light source 200, a lens assembly 400, and a housing 900.

Figure 2:
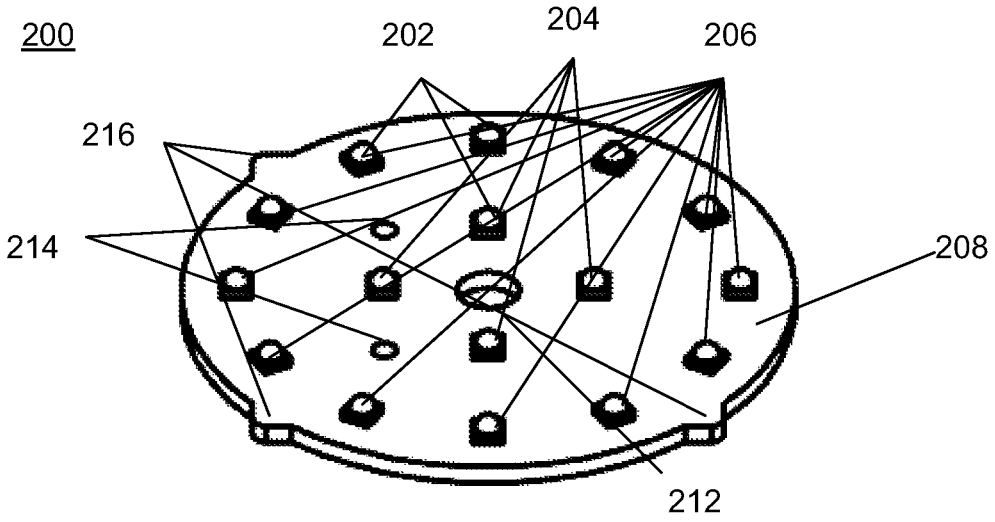
FIG. 2 is a perspective view of a light source of the luminaire illustrated in FIG. 1.

According to the present embodiment of the invention, a light source 200 is presented, illustrated in FIG. 2. The light source 200 may comprise one or more light emitting elements 202. The light emitting elements 202 may be any known lighting element including, but not restricted to, light emitting diodes (LEDs), incandescent lights, gas-discharge lamps, halogen lamps, and lasers. In the present embodiment, the light emitting elements may be LEDs. More specifically, the light source includes a first set of light emitting elements 204 and a second set of light emitting elements 206.

The light source 200 according to the present embodiment may further include a platform 208. The platform 208 may be configured to facilitate the attachment of light emitting elements 202 thereto. Each of the light emitting elements 202 of the first and second sets of light emitting elements 204, 206 may be attached to the platform 208.

The light emitting elements 202 of the first and second sets of light emitting elements 204, 206 may be positioned on the platform 208 in order to achieve a desired light distribution. For example, the each of the first set and the second set of light emitting elements 204, 206 may be positioned in an approximately circular distribution about the center of the platform 208. The diameter of the circular distribution of the first and second sets of light emitting elements 204, 206 may vary according to the quantity of light emitting elements included in each set. For example, the first set 204 may include four light emitting elements, and the second set 206 may include twelve light emitting elements. Other quantities of light emitting elements 202 for each of the first and second sets 204, 206 are contemplated and included by the invention. Moreover, alternative positioning of the constituent light emitting elements 202 is also contemplated and includes all geometric patterns including, without limitation, triangles, rectangles, squares, pentagons, hexagons, grids, and any other geometric formation.

Figure 3:
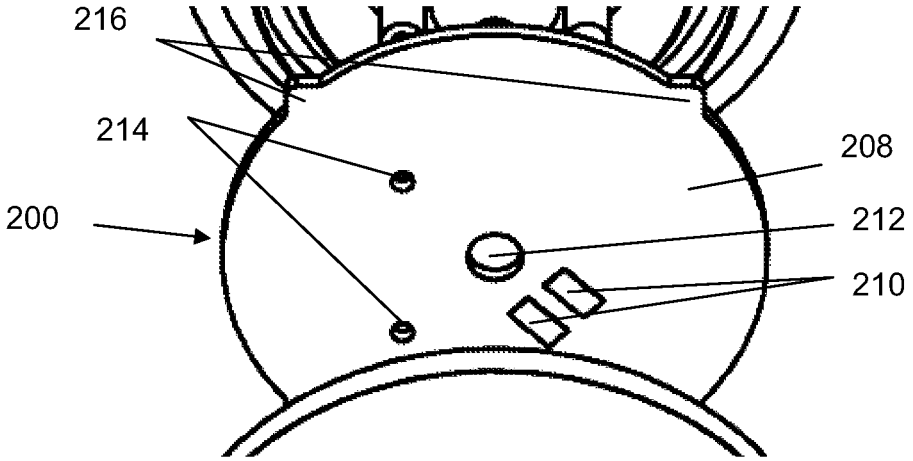
FIG. 3 is a partial perspective view of the light source illustrated in FIG. 2.

Furthermore, the platform 208 may include an electrical contact 210 and electrical connections (not shown), as illustrated in FIG. 3. The electrical contact 210 may be configured to permit electrical coupling thereto. The electrical connections may be configured to electrically couple the electrical contact 210 with each light emitting element 202, shown in FIG. 2. For example, the electrical connections may be conductive pathways formed in the surface of the platform 208, and the electrical contact 210 may be a conductive pad permitting the attachment of an electrical conductor thereto. In another example, the electrical connections may be conductive pathways formed within the platform. In the present embodiment, the electrical contact 210 may be two conductive pads formed on a lower surface of the platform 208. Furthermore, the electrical contact 210 and electrical connections may be configured to permit control of each individual light emitting element 202, groups of light emitting elements, such as the first and second sets of light emitting elements 204, 206, or all the light emitting elements 202.

The platform 208 may also include at least one void formed in the platform 208 configured to permit an attachment member of the lens assembly to pass therethrough. In the present embodiment, a first void 212 is formed in the center of the platform 208 and a pair of second voids 214 are formed a distance from the center of the platform 208.

The platform 208 may further include one or more projecting members 216 extending radially outward from the perimeter of the platform 208. The projecting members 206 may be configured to engage with another element of the lighting apparatus 100 to permit attachment of the platform 208 thereto.

Where the light source 200 comprises first and second sets of light emitting elements 204, 206, and where the light emitting elements are LEDs, the types of LEDs used in the first and second sets of LEDs may be the same or they may be different. In the case where they are different, the types of LEDs selected for the first and second sets may be selected according to desired color mixing, color temperature, and color rendering index (CRI) outcomes. In one embodiment, the first set of LEDs may be red LEDs and the second set of LEDs may be white LEDs. In another embodiment, the first set of LEDs may be white LEDs and the second set of LEDs may be red LEDs. It should be understood that all the various combinations of LED colors are contemplated and included within this invention. Furthermore, each of the first and second sets of LEDs may include LEDs of two or more colors. For instance, the first set of LEDs may include at least one red LED and at least one white LED. Similarly, all the various combinations of LED colors within each set of LEDs is contemplated and included within this invention.

Figure 4:
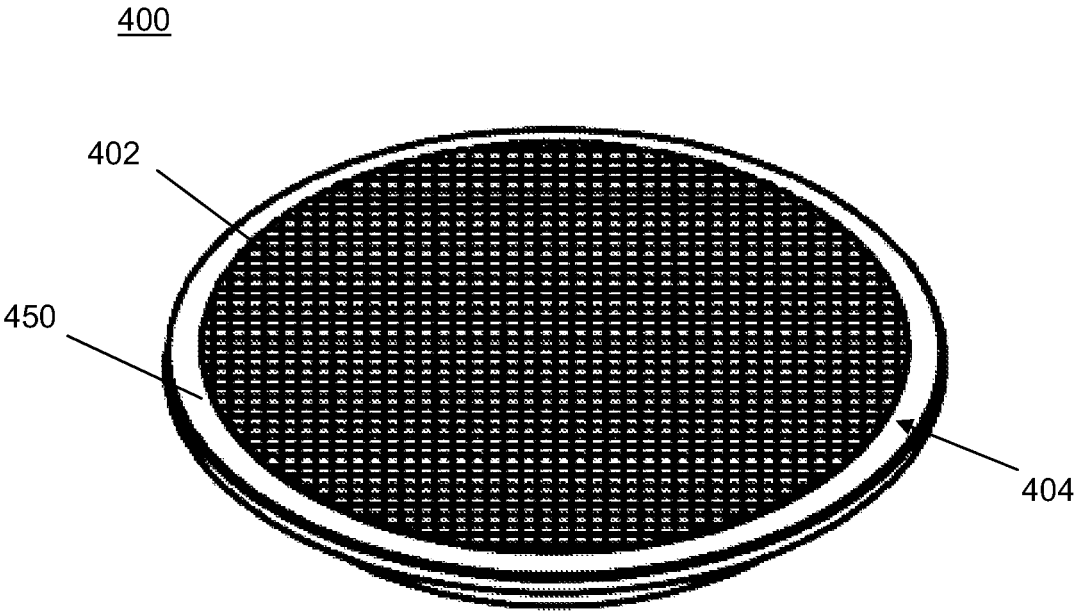
FIG. 4 is a perspective view of a lens assembly of the luminaire illustrated in FIG. 1.

As illustrated in FIG. 4, a lens assembly 400 is provided according to an embodiment of the present invention. The lens assembly 400 may include a lens 402 and a body member 450. The lens 402 may be configured to generally refract and transmit light from a light source through the lens 402 and into the environment. The lens 402 may further be configured to have refractive properties that result in a variable distribution of light.

In one embodiment, the lens 402 may include an emitting surface 404 having uniform refraction properties throughout the entire emitting surface 404. The emitting surface 404 may be polished by any suitable polishing method including, without limitation, diamond polishing, dry blasting, electrical discharge machining, or grit blasting. The polished surface of the emitting surface 404 may be polished to a smoothness within a range of smoothness between about 8 microinches to about 100 microinches.

Figure 5:
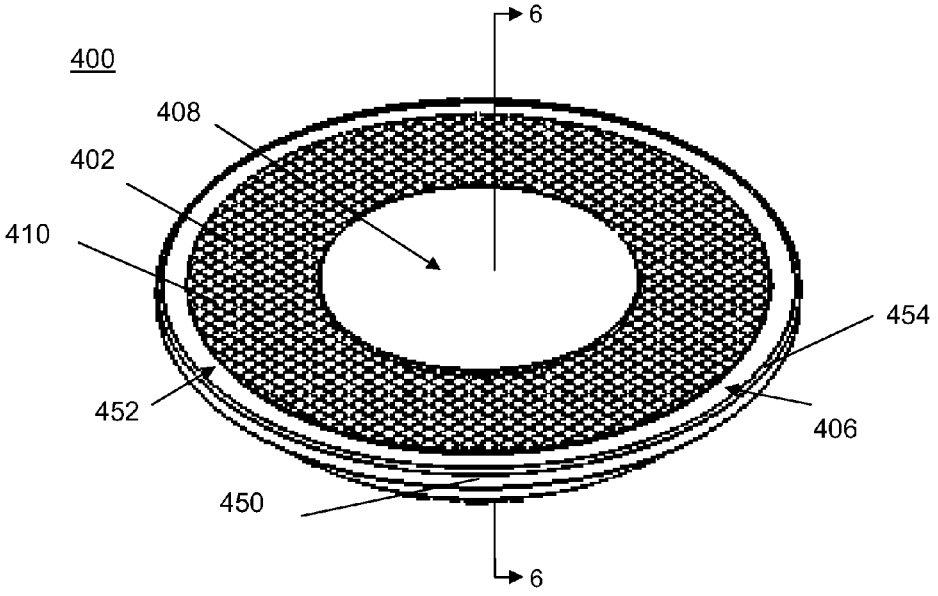
FIG. 5 is a perspective view of an alternative embodiment of a lens assembly of the luminaire illustrated in FIG. 1.

In another embodiment, the lens 402 may include an emitting surface 406 having a first refraction section 408 and a second refraction section 410, as illustrated in FIG. 5. The first and second refraction sections 408, 410 may be shaped and positioned in any way on the emitting surface 406. Furthermore, the first and second refraction sections 408, 410 may be configured to have any refraction properties desired. For example, and not by limitation, the first refraction section 408 may have a generally circular shape and be positioned at approximately the center of the emitting surface 406, and the second refraction section 410 may have an annular shape and be positioned substantially around the first refraction section 408.

The first refraction section 408 may have a polished surface. For example, the polished surface of the first refraction section 408 may be diamond polished. Moreover, the polished surface of the first refraction section 408 may be polished to a smoothness within a range of smoothness between about 4 microinches to about 8 microinches.

Similarly, the second refraction section 410 may have a polished surface. For example, the polished surface of the second refraction section 410 may be polished by a number of polishing methods, including dry blasting, electrical discharge machining, or grit blasting. The polished surface of the second refraction section 410 may be polished to a smoothness within a range of smoothness between about 8 microinches to about 100 microinches.

Figure 6:
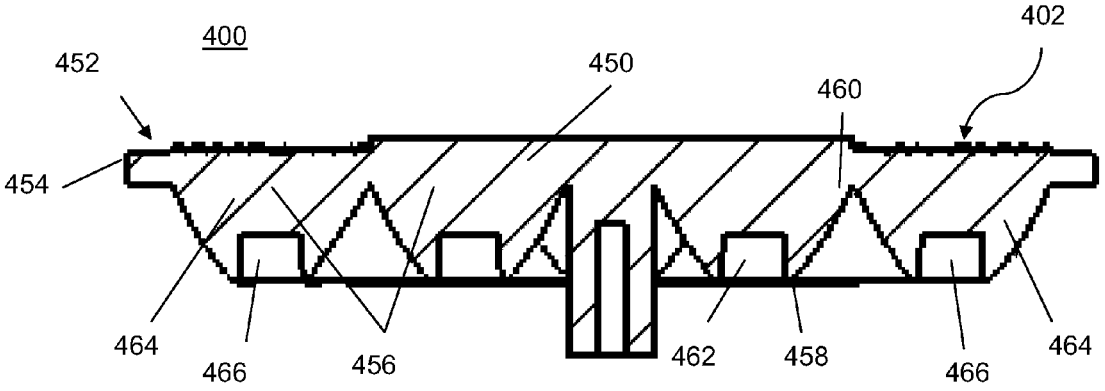

Now referring back to FIG. 4, the body member 450 of the lens assembly 400 may be configured to support the lens 402. Turning now to FIGS. 5 and 6, in order to support and prevent movement of the lens 402 with respect to the body member 450, the body member 450 may include a support surface 452 positioned generally upwards toward the lens 402, wherein the lens 402 is fixedly attached to the support surface 452. The lens 402 may be attached to the support surface 452 by any method known in the art, including, but not limited to, adhesives, glues, fasteners, and interference fits. Additionally, the body member 450 may include a rim 454 disposed substantially about the perimeter of the support surface 452.

Furthermore, the body member 450 may be configured to facilitate the transmission of light from the light source 200 to the lens 420. Accordingly, in one embodiment of the invention, the body member 450 may include one or more light source receiving members 456. The light source receiving members 456 may extend generally downward from the support surface 452 and each may be associated with the light source 200 as illustrated in FIG. 2. Furthermore, each light source receiving member 456 may be associated with a light emitting element 202 of the light source 200. In an alternative embodiment, each light source receiving member 456 may be associated with more than one light emitting element 202. In another alternative embodiment, two or more light source receiving members 456 may be associated with a single light emitting element.

Figure 7:
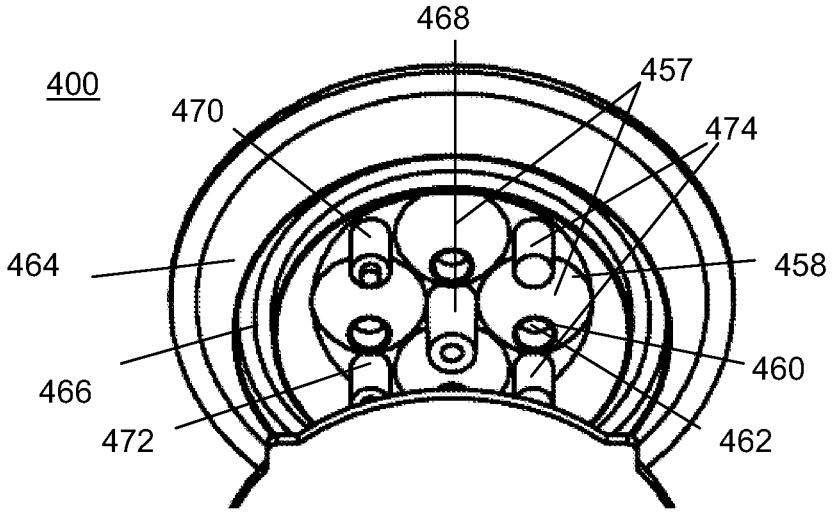
FIG. 7 is a partial perspective view of a lens assembly of the luminaire illustrated FIG. 1.

The light source receiving members 456 may be configured to facilitate the transmission of light from its associated light emitting element 202 to the lens 402. In the present embodiment of the invention, at least one of the light source receiving members 456 may be formed generally as a conical frustum 457 having an upper base 458 and a lower base 460, as illustrated in FIG. 7. The light source receiving members 456 may include a recessed section 462 in the lower base. The recessed section 462 may be positioned and dimensioned so as to permit a light emitting element to be accommodated there within. The dimensions of the light source receiving members 456 may vary according to, without limitation, the size of the light emitting element being disposed therein, the number of light emitting elements, the proximity of light emitting elements to one another, and desired refraction properties. As to desired refraction properties, such properties may include, without limitation, beam angle and intensity.

Furthermore, one or more of the light source receiving members 456 may be formed as an annular ridge 464. The annular ridge 464 may be associated with two or more light emitting elements that are positioned to approximately form a circle. The annular ridge 464 may include a recessed section 466 at approximately the apex of the ridge. The recessed section 466 may be of sufficient depth to permit a light emitting element to be positioned there within.

In some embodiments, the lens assembly 400 may have two or more light source receiving members formed as annular ridges. Such embodiments may have the annular ridges be successive in diameter and in number of light emitting elements disposed therein.

In alternative embodiments, at least one of the light source receiving members may be formed as a ridge in a configuration other than an annulus. For instance, such shapes include triangles, squares, rectangles, pentagons, hexagons, octagons, or any other polygon.

The light source receiving members 456 may be formed of a translucent or transparent material permitting the transmission and refraction of light therethrough. For example, the material may have a minimum optical transmissivity of at least 88%. Furthermore, and without limitation, the material may be polycarbonate. The light source receiving members 456 may be polished. For example the light source receiving members may be diamond polished to have a smoothness within a range of smoothness between about 4 microinches to about 8 microinches.

The light source receiving members 456 may be positioned approximately above a light emitting element. For example, referring to FIG. 8, each of the frustum-shaped light source receiving members 457 may be positioned above an individual light emitting element, and the annular ridge light source receiving member 464 may be positioned above two or more light emitting elements arranged into an approximately circular pattern. For instance, the frustum-shaped light source receiving members 457 may be positioned above each of the light emitting elements 202 of the first set of light emitting elements 204 such that each of the light emitting elements 202 of the first set of light emitting elements 204 may be disposed within the recessed section 462 of the frustum-shaped light source receiving members 457. Furthermore, the annular ridge light source receiving member 464 may be positioned above each of the light emitting elements 202 of the second set of light emitting elements 206 such that each light emitting element 202 of the second set of light emitting elements 206 is disposed within the recessed section 466 of the annular ridge light source receiving member 464.

In order to maximize transmissivity, both the lens and the light source receiving members should be substantially free from flash, oil and contaminants, and should be substantially free from scratches, chips, crazing, bubbles, and inclusions to within commercial tolerances.

Figure 8:
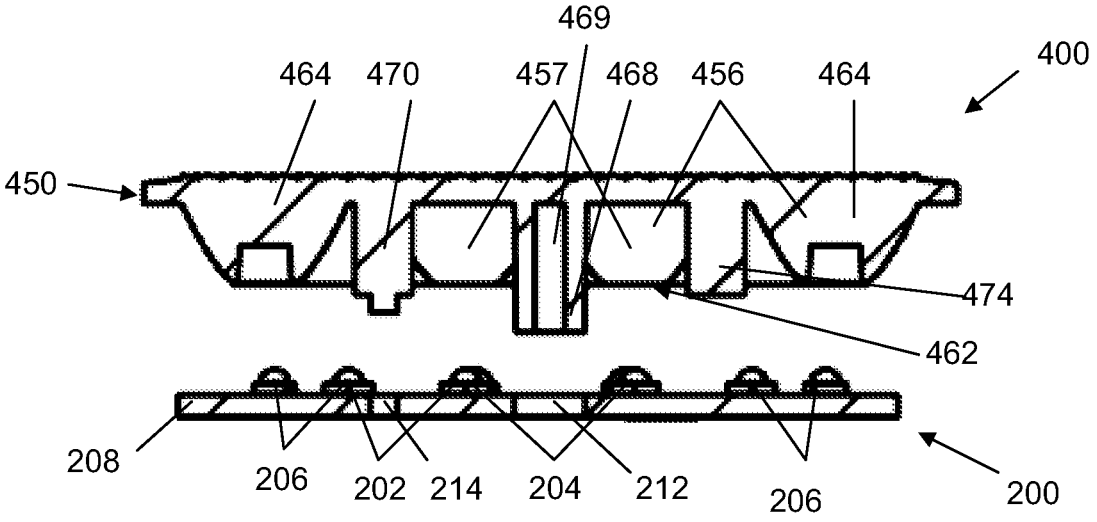
FIG. 8 is a side section view of a lens assembly and a light source of the luminaire illustrated FIG. 1.

Referring to FIGS. 7 and 8, the body member 450 may further include one or more attachment members. The attachment members may extend generally downward, extending beyond the light source receiving members 456. The attachment members may be configured to attach to another element of the lighting apparatus according to any suitable method, including, but not limited to, fasteners, glues, adhesives, welding, or interference fit. Moreover, the attachment members may be of varying sizes. For instance, a first attachment member may be longer and have a greater diameter than a second attachment member. Furthermore, the attachment members may be configured to include a lumen, such as a threaded lumen, to facilitate that attachment of a fastener thereto. In the present embodiment, a first attachment member 468 is disposed generally in the center of the body member having a lumen 469, and a pair of second attachment members 470, 472 are disposed a distance away from the center of the body member. The first attachment member 468 may have a length and a diameter that is greater than the length and diameter of each of the second attachment members 470, 472. The first attachment member 468 may pass through the first void 212 of the platform 208 and the pair of second attachment members 470, 472 may pass through the pair of second voids 214, thereby preventing rotation between the lens assembly 400 and the light source 200 with respect to each other.

The body member 450 may further include one or more support posts 474 extending generally downward, beyond the light source receiving members 456. The support posts 474 may interface with a surface of the platform 208, thereby supporting the lens assembly above the light source.

Through the distribution of the first and second sets of light emitting elements as well as refraction by the light source receiving members and the lens, a light distribution is achieved. The light distribution of the first and second sets of light emitting elements may be considered individually as well as in combination. For example, where the first set of light emitting elements includes four LEDs positioned substantially at the center of the platform, they may emit light having an intensity of about 7.4 candelas (cd) per lumen (lm), or 7.4 cd/lm, having a beam angle of about 18 degrees. Furthermore, where the first set of LEDs is white LEDs, they may operate at an efficiency of about 97.2%. This provides a light having high center beam candle power (CBCP), but has a relatively narrow beam and is not well suited to lighting a broad area. Also for example, where the second set of light emitting elements may include 12 LEDs positioned in a circle about the first set of light emitting elements, they may emit light having an intensity of about 0.9 cd/lm and a beam angle of about 47 degrees. Where the second set of LEDs is red LEDs, they may operate at an efficiency of about 86.6%. This provides a light having a light distribution pattern following a gradual gradient across a relatively wide area, but has low CBCP. Therefore, it provides light that is less aesthetically pleasing and does not conform to the traditional operation of lighting assemblies. However, the combination of the first and second sets of LEDs yields a light that has both high CBCP and distributes light following a gradual gradient. A person having ordinary skill in the art will recognize that different arrangements, numbers, and types of light emitting elements will result in different light distribution characteristics. Accordingly, all arrangements, numbers, and types of light emitting elements yielding a light having a light distribution of a high CBCP as well as a more even distribution pattern across a relatively wide area.

Figure 9:
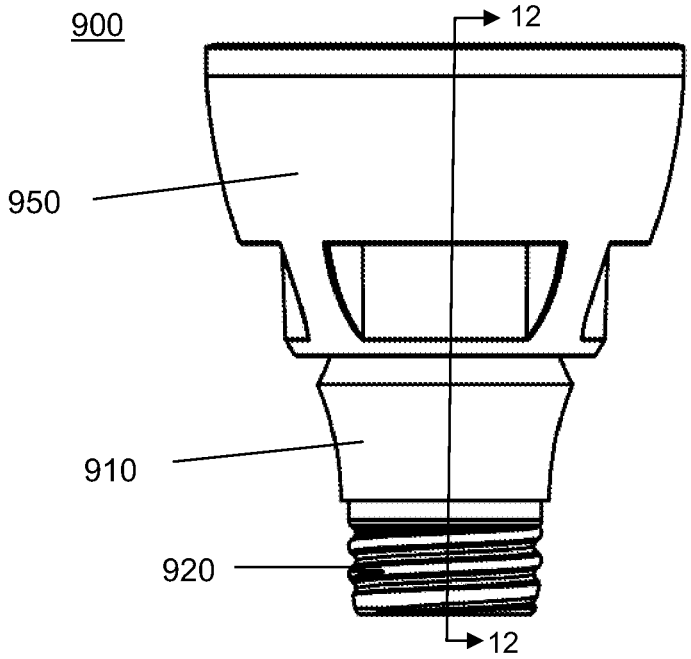
FIG. 9 is a side view of a housing of the luminaire illustrated in FIG. 1.

Referring now to FIG. 9, according to the present embodiment of the invention, the luminaire may include a housing 900. The housing may include an inner housing 910 and an outer housing 950. As perhaps best illustrated in FIG. 10, the inner housing 910 may include a first end 912, a second end 914, and a sidewall 916, wherein the sidewall defines an internal area 918. The sidewall 916 may be formed approximately cylindrically having varied inside and outside diameters.

The inner housing 910 may include a base 920 that may be positioned at the first end 912 of the inner housing 910 and be configured to attach to a standard light socket. Types of sockets included are Edison screw bases, bayonet, bi-post, bi-pin and wedge. The base 920 may further include an electrical contact (not pictured) formed of an electrically conductive material, the electrical conductor being configured to conduct electricity from a light socket to the lighting apparatus.

Figure 11:
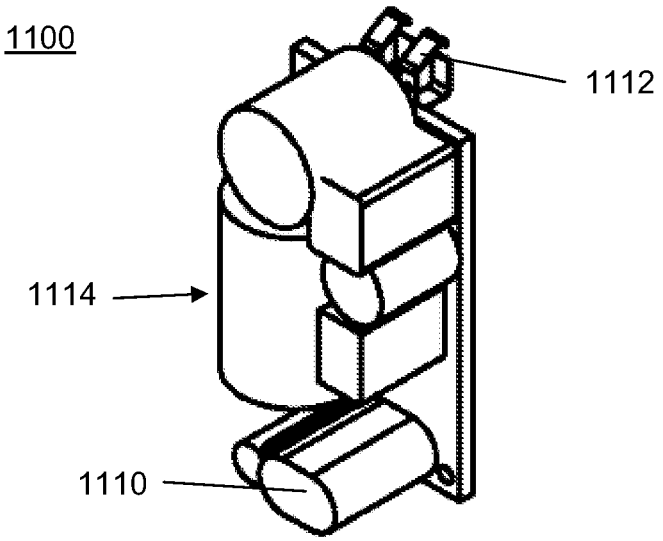
FIG. 11 is a perspective view of a power source of the luminaire illustrated in FIG. 1.
Figure 12:
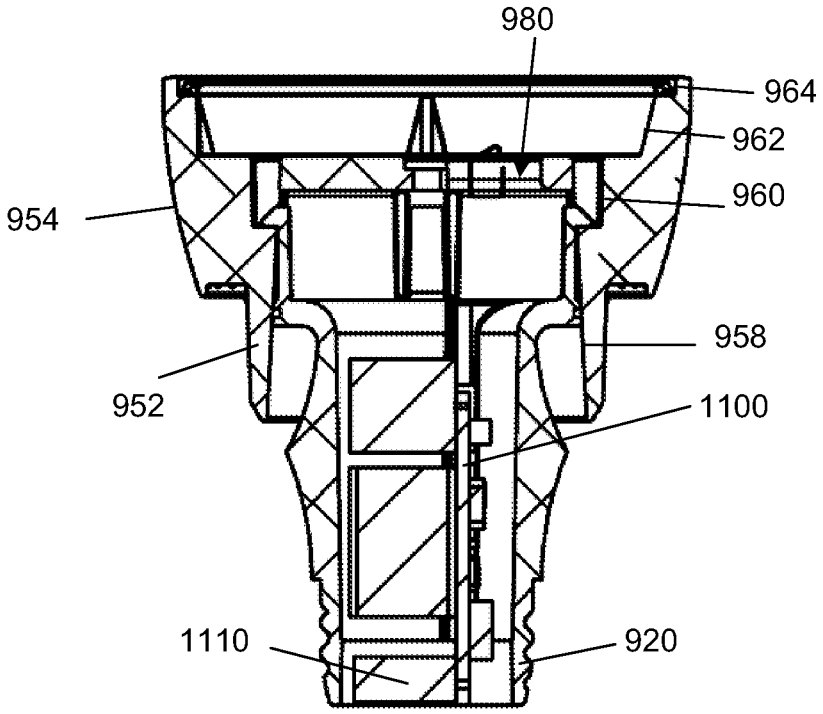
FIG. 12 is a side sectional view of the housing illustrated in FIG. 9 and taken through line 12-12.

Referring now to FIG. 11, according to a present embodiment of the invention, a power source 1100 of the luminaire is presented. The power source 1100 may include a first electrical contact 1110, a second electrical contact 1112, and circuitry 1114. As shown in FIG. 12, the power source 1100 may be disposed substantially within the base 920 and internal area of the housing and positioned such that the first electrical contact 1110 is adjacent the base 920 and the second electrical contact (not shown in FIG. 12) is toward the second end 914. The first electrical contact 1110 may be electrically coupled to the electrical contact of the base 920, thereby providing a conduit for electricity to be delivered to the power source 1100.

Now referring back to FIG. 11, the first electrical contact 1110 may also be electrically coupled to the circuitry 1114. The circuitry 1114 may be configured to condition the electricity conducted by the first electrical contact 1110 to meet the requirements of the light source. For example, the first electrical contact 1110 may be coupled, via the electrical contact of the base 920 as illustrated in FIG. 12, to a standard wall outlet that delivers 120-volt alternating current (AC) electricity. Furthermore, the light source may include LEDs requiring 3-volt direct current (DC) power. Accordingly, the circuitry 1114 will include the necessary components for converting 120-volt AC power to 3-volt DC power. It is understood that the electricity delivered by the first electrical contact 1110 and the electricity required may vary both in voltage and current. For instance, the delivered electricity may be 240-volt AC and the electricity required may be 5-volt DC. These and all other combinations, including DC to AC conversion or no conversion at all, are contemplated and included within the invention.

The second electrical contact 1112 may be configured to permit electrical coupling to the electrical contact of the light source as illustrated in FIG. 3. In the present embodiment, the second electrical contact 1112 may include a first conductive prong 1116 and a second conductive prong 1118. The first and second conductive prongs 1116, 1118 may be electrically coupled with conductive pads 210 on the lower surface of the platform 208 as shown in FIG. 3, thereby electrically coupling the power source 1100 to the light source 200.

The circuitry 1114 of the power supply 1100 may include a microcontroller. The microcontroller may be programmed to control the operation of the light emitting elements. More specifically, the microcontroller may be programmed to selectively operate the first and second sets of light emitting elements described hereinabove according to an input. The input may be the electricity provided via the electrical connector of the base. For instance, electrical power having a first characteristic may instruct the microcontroller to illuminate the first set of light emitting elements, electrical power having a second characteristic may instruct the microcontroller to illuminate the second set of light emitting elements, and electrical power having a third characteristic may instruct the microcontroller to illuminate both the first and second sets of light emitting elements. Furthermore, the microcontroller may be programmed to selectively illuminate individual light emitting elements.

Figure 13A:
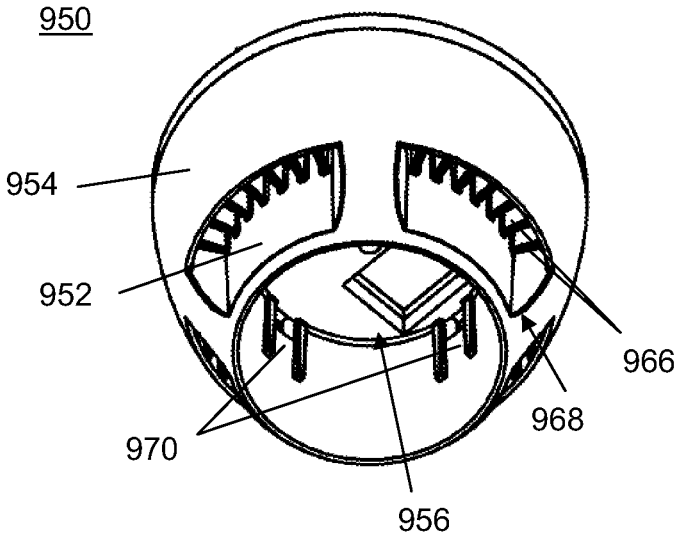
FIG. 13*a* is a perspective view of an outer housing of the housing depicted in FIG. 9.

Now referring back to FIG. 9, the outer housing 950 may be configured to be positioned about at least a portion of the inner housing 910. Referring now to FIGS. 12 and 13*a*, the outer housing 950 may include an inner wall 952 and an outer wall 954 defining a space there between, wherein the inner wall 950 defines an internal area 956 that defines a first internal region 958, a second internal region 960, a third internal region 962, and a fourth internal region 964, each having a different diameter. Moreover, the inner housing 910 may be at least partially disposed within the internal area 956 of the outer housing 950.

The outer housing 950 may be configured to act as a heat sink for the light source. Accordingly, the outer housing 950 may include features that increase the cooling capability of the outer housing. In the present embodiment, the outer housing may include a plurality of fins 966. The fins 966 may be positioned in the space between the outer wall 954 and the inner wall 952 and attached to at least one of the outer wall 954, the inner wall 952, and a disc 974, discussed in detail hereinbelow. The fins 966 may be spaced apart so as to permit fluid flow there between. Moreover, the outer wall 954 may include one or more apertures 968 positioned to facilitate the flow or air through the fins 966. Furthermore, the outer housing 950 may be formed at least partially of a heat conducting material. Additional information directed to the use of heat sinks for dissipating heat in an illumination apparatus is found in U.S. Pat. No. 7,922,356 titled Illumination Apparatus for Conducting and Dissipating Heat from a Light Source, and U.S. Pat. No. 7,824,075 titled Method and Apparatus for Cooling a Light Bulb, the entire contents of each of which are incorporated herein by reference. It is also contemplated that portions of the luminaire may be vented to advantageously dissipate heat generated by the LED. Additional information directed to venting portions of a luminaire is disclosed in U.S. Provisional Patent Application No. 61/642,257 titled Luminaire Having a Vented Enclosure, as well as U.S. Provisional Patent Application No. 61/642,205 titled Luminaire with Prismatic Optic, the entire contents of each of which are incorporated herein by reference.

Figure 10:
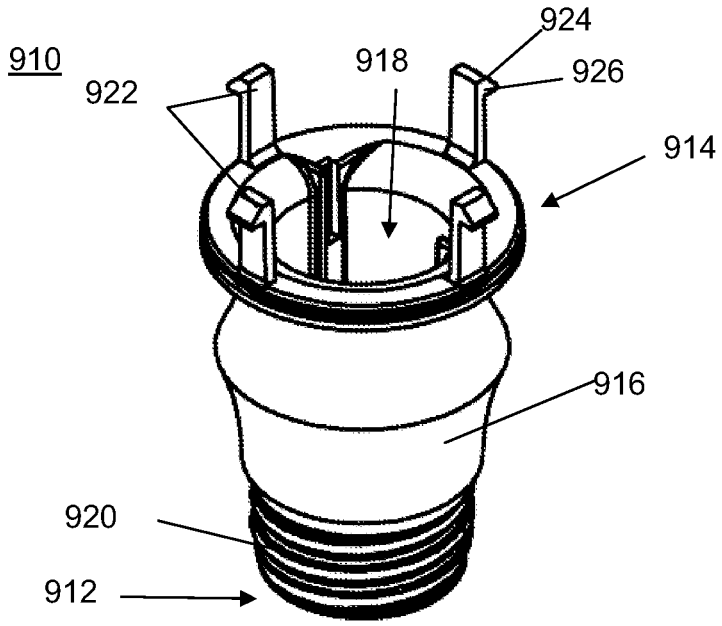
FIG. 10 is a perspective view of an inner housing of the housing depicted in FIG. 9.

Now referring to FIGS. 10, 12 and 13, the inner housing 910 may be attached to the inner wall 952 of the outer housing 950 to prevent movement with respect to each other. The method of attachment may be any method suitable to prevent movement during installment and operation of the lighting apparatus and may include, without limitation, adhesives, glues, fasteners, welding, and interference fits. In the present embodiment, the inner housing 910 may include one or more tangs 922 extending generally upwards from the sidewall 916 at the second end 914. The tangs 922 may include a taper 924 and a catching surface 926 to facilitate the engagement of the tangs. More specifically, the tangs 922 may be formed of a flexible material permitting elastic deformation of the tangs 922, and the taper 924 may accomplish the plastic deformation by pushing against a surface as the tangs 922 are translated across said surface. Furthermore, the outer housing 950 may include one or more catches 970 formed into the inner wall 952 in the first region 958. Each catch 970 may be associated with a tang 922, wherein the catching surface 926 of each tang 922 engages with the catch 970, thereby releasably engaging the inner housing 910 with the outer housing 950.

Figure 13B:
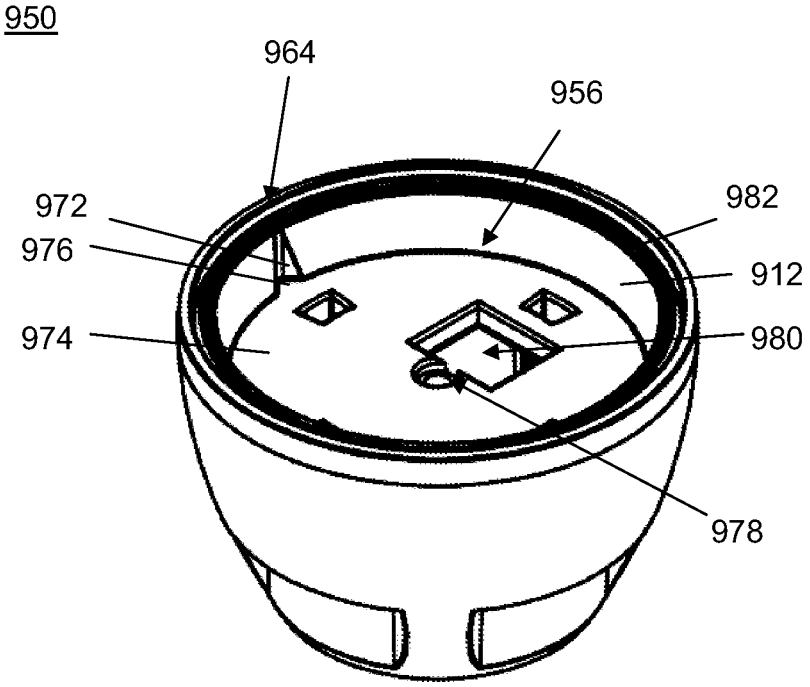
FIG. 13*b* is a second perspective view of the outer housing depicted in FIG. 13*a*.

Referring now to FIG. 13*b*, the outer housing 950 may include one or more recessions 972 formed in the inner wall 912. The recessions 972 may be configured to cooperate with the projecting members 216 of the platform 208 as illustrated in FIG. 3 to permit disposal of the projecting members 216 there within, thereby engaging the platform 208 with the outer housing 950. When so disposed, the engagement between the outer housing 950 may prevent the rotation of the platform with respect to the outer housing 950.

According to the present embodiment of the invention, a disc 974 is presented. The disc 974 may be disposed within the internal area 956 of the outer housing 950. The disc 974 may be fixedly attached to the inner wall 912. Any method may be used to attach the disc 974, including, but not limited to, adhesives, glues, fasteners, welding, and interference fits. For example, the disc 974 may include one or more projecting members 976 configured to engage with the recessions 972 of the inner wall 912. The disc 974 may be positioned underneath the platform 908 as illustrated in FIG. 3, therefore the recessions 972 may be configured to permit disposal of the projecting members 974 of the disc 974 as well as the projecting members 216 of the platform 208 therein. Additionally, the disc 974 may be formed of a thermally conductive material.

The disc 974 may include a first void 978 disposed at the center of the disc 974 and a second void 980 disposed approximately adjacent the first void. The first void 978 may be configured to permit a fastener to pass therethrough. Moreover, the first void 978 may include threads to facilitate the attachment of a fastener thereto. The second void 980 may facilitate the electrical coupling of the second electrical contact of the power source and the electrical contact of the light source. For instance, the second void 980 may be configured to permit at least a portion of the power source 1100 to be positioned therein, as illustrated in FIG. 12.

The outer housing 950 may be configured to facilitate attachment of the lens assembly 400, as illustrated in FIG. 6, thereto. More specifically, the rim 454 of the light assembly 400 may be configured to interface with the fourth internal region 964 of the outer housing, thereby facilitating attachment. The outer housing 950 may include an interfacing surface 982 in the fourth internal region 964 that may interface with the rim 454. In order for the rim 454 to interface with the interfacing surface 982, the diameter of the fourth internal region 964 may be greater than the diameter of the rim 454. The rim 454 may be attached to the interfacing surface 982 by any suitable method, including, but not limited to, adhesives, glues, welding, fasteners, and interference fit.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A luminaire comprising:

a housing;

a light source carried by the housing comprising a first set of light emitting elements and a second set of light emitting elements; and a lens assembly carried by the housing, the lens assembly comprising a lens comprising:

a first refraction section having a surface smoothness within a first range from 4 microinches to 8 microinches, and a second refraction section having a surface smoothness within a second range from 8 microinches to 100 microinches, wherein the first range is not equal to the second range;

wherein the first set of light emitting elements is configured to emit light at a first beam angle of about 18 degrees;

wherein the second set of light emitting elements is configured to emit light at a second beam angle of about 47 degrees;

wherein the light emitted by the first set of light emitting elements and the second set of light emitting elements combine to form a combined light;

wherein the combined light has a center beam and a gradient; and wherein the center beam has a greater candle power than the gradient.

2. A luminaire according to claim 1 wherein the first set of light emitting elements comprises a white light-emitting diode (LED); and wherein the second set of light emitting elements comprises a red LED.

3. A luminaire according to claim 1 wherein the first set of light emitting elements emit light having a luminous intensity of at least about 7.4 candelas per lumen.

4. A luminaire according to claim 1 wherein the second set of light emitting elements emit light having a luminous intensity of about at least 0.9 candelas per lumen.

5. A luminaire according to claim 1 further comprising a controller that is configured to operate each of the first set of light emitting elements and the second set of light emitting elements independently.

6. A luminaire according to claim 5 wherein the controller is configured to receive an input; and wherein the controller is programmable to operate the first set of light emitting elements and the second set of light emitting elements responsive to the input.

7. A luminaire according to claim 6 wherein the input is an electrical signal transmitted to the controller via an electrical connector of the housing.

8. A luminaire according to claim 6 wherein the controller is programmable to control the luminous intensity of light emitted by each of the first set of light emitting elements and the second set of light emitting elements through pulse-width modulation.

9. A luminaire according to claim 1 wherein the lens assembly further comprises one or more light source receiving members.

10. A luminaire according to claim 9 wherein the light source receiving members are configured to comprise one or more refraction properties selected from a group consisting of beam angle and luminous intensity.

11. A luminaire comprising:

a housing;

a light source carried by the housing comprising a first set of light emitting elements and a second set of light emitting elements;

a lens assembly carried by the housing, the lens assembly comprising a lens comprising:

a first refraction section having a surface smoothness within a first range from 4 microinches to 8 microinches, and a second refraction section having a surface smoothness within a second range from 8 microinches to 100 microinches; and a controller;

wherein the first set of light emitting elements is configured to emit light at a first beam angle of about 18 degrees;

wherein the second set of light emitting elements is configured to emit light at a second beam angle of about 47 degrees;

wherein the light emitted by the first set of light emitting elements and the second set of light emitting elements combine to form a combined light;

wherein the controller is configured to operate each of the first set of light emitting elements and the second set of light emitting elements independently;

wherein the controller is configured to receive an input;

wherein the controller is programmable to operate the first set of light emitting elements and the second set of light emitting elements responsive to the input; and wherein the controller is programmed to operate the first set of light emitting elements and the second set of light emitting elements so as to alter center beam candle power and a gradient of the combined light.

12. A luminaire according to claim 11 wherein the input is an electrical signal transmitted to the controller via an electrical connector of the housing.

13. A luminaire according to claim 11 wherein the lens assembly further comprises one or more light source receiving members.

14. A luminaire according to claim 13 wherein the light source receiving members are configured to comprise one or more refraction properties selected from a group consisting of beam angle and intensity.

15. A luminaire according to claim 11 wherein the controller is programmable to control the luminous intensity of light emitted by each of the first set of light emitting elements and the second set of light emitting elements through pulse-width modulation.

* * * * *